United States Patent [19]

Ohrberg et al.

[11] 4,435,130

[45] Mar. 6, 1984

[54] HYDRAULIC PLANETARY PISTON ENGINE HAVING FREE WHEELING VALVE

[75] Inventors: Carl V. Ohrberg; Gunnar L. Hansen, both of Nordborg, Denmark

[73] Assignee: Danfoss A/S, Nordborg, Denmark

[21] Appl. No.: 288,039

[22] Filed: Jul. 29, 1981

[30] Foreign Application Priority Data

Aug. 8, 1980 [DE] Fed. Rep. of Germany ..... 3029997

[51] Int. Cl.[3] ..... F04B 49/08; F04C 1/06

[52] U.S. Cl. ..... 417/310; 410/61 B

[58] Field of Search ..... 418/61 B; 417/310, 283

[56] References Cited

U.S. PATENT DOCUMENTS 3,572,983 3/1971 McDermott ..... 418/61 B 3,799,201 3/1974 Hansen et al. ..... 418/61 B 4,076,462 2/1978 Pippenger ..... 417/310

*Primary Examiner*—Leonard E. Smith

*Attorney, Agent, or Firm*—Wayne B. Easton

[57] ABSTRACT

The invention relates to a hydraulic planetary piston motor of the type having an externally serrated pinion gear which meshes with an internally serrated ring gear and has rotatable and orbital movement relative thereto. The unit has plate type distributor valving with fixed and moveable members and a piston, subject to control pressures on both sides thereof, for biasing the moveable valve member into sealing engagement with the fixed valve member. A change-over valve which may be pressure controllable functions to either cause biasing of the piston to effect the sealing mode or to relieve the biasing to cause a separation of the valve members to effect a short circuiting unloading thereof.

4 Claims, 1 Drawing Figure

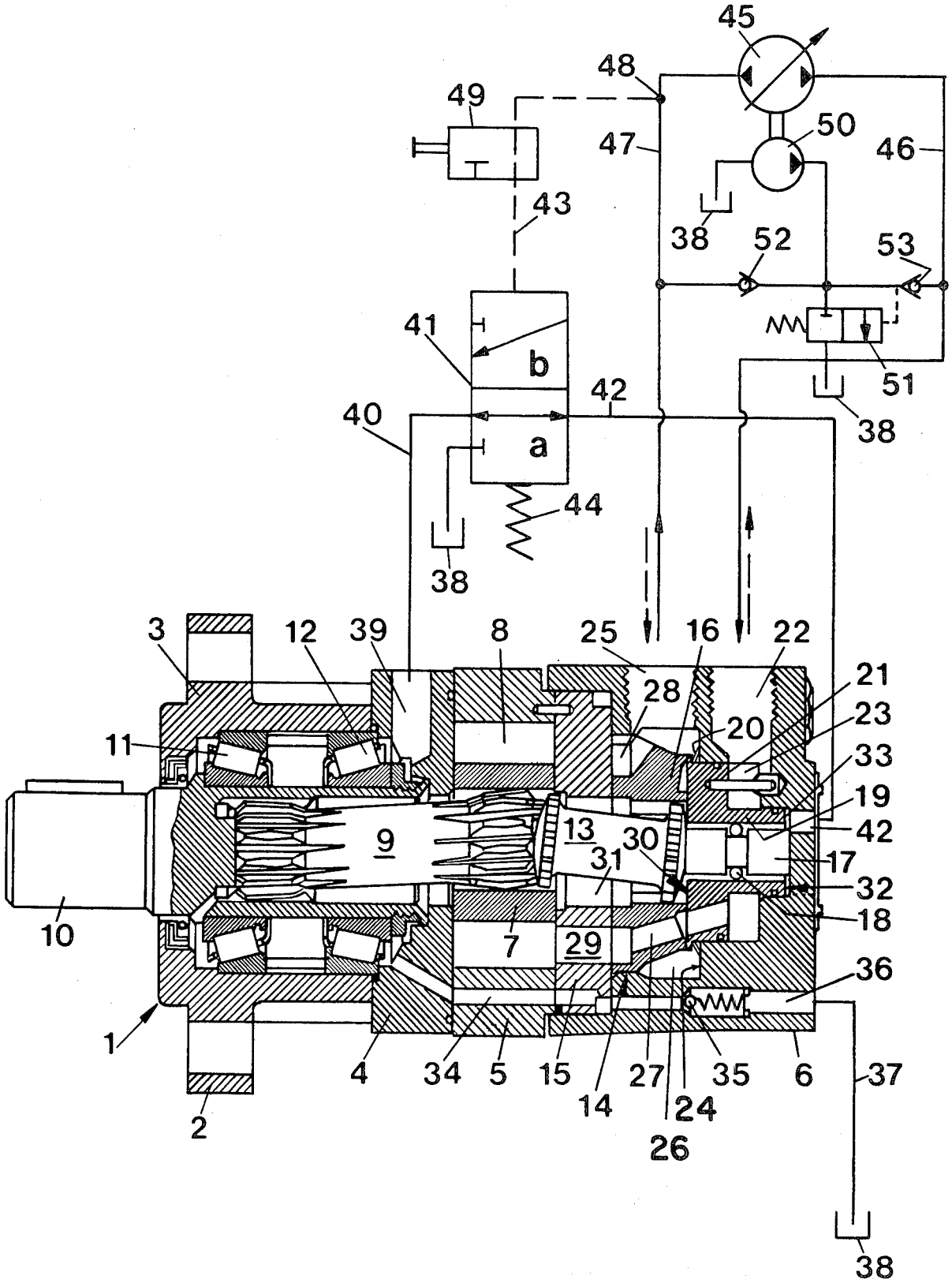
45
48
49
50
47
46
43
38
52
53
41
b
42
51
40
a
38
44
38
3
12
39
8
25
16
22
21
28
23
11
20
33
19
9
13
30
42
31
17
32
10
7
29
18
36
1
4
34
5
15
27
35
6
37
14
24
2
26
38

HYDRAULIC PLANETARY PISTON ENGINE HAVING FREE WHEELING VALVE

The invention relates to a hydraulic planetary piston engine comprising an externally serrated pinion and an internally serrated ring gear in mesh therewith, a distributing valve consisting of a fixed valve plate and an annular rotary valve connected to rotate with the rotating gear, and a pressure piston which presses the rotary valve against the valve plat under the influence of the arriving pressure fluid and which has two substantially equal pressure faces on opposed sides, one of the pressure faces facing the interior of the engine and the other a housing chamber.

In a known planetary piston engine of this kind (DE-AS 22 20 350), springs are provided to prebias the pressure piston against the rotary valve. Further, the pressure piston has two annular faces on the side remote from the rotary valve, one face being subjected to the arriving pressure fluid and the other to the pressure of the outflowing pressure fluid, the same applying when the direction of rotation is reversed. The pressure piston has a bore which is penetrated by a supporting pin for a cardan shaft. The inteior of the engine and the housing chamber are interconnected by way of the gap between the bore and pin. Consequently, the pressure obtaining in the interior of the engine has no influence on the pressure piston. In addition, the interior in such engines is connected directly to the tank. As a result, the pressure piston is instrumental in achieving a good seal between the rotary valve and the valve plate.

It is often desired to drive such an engine during free-wheeling operation. This can only be achieved by interposing a free-wheeling valve between the two conduits for the inflowing and outflowing pressure medium, the entire pressure fluid or a substantial proportion thereof being passed through the free-wheeling valve. Such a valve is comparatively large and expensive.

The invention is based on the object of providing a planetary piston engine of the aforementioned kind in which the free-wheeling property can be achieved at less expense.

This problem is solved according to the invention by an overpressure valve which holds the pressure in the interior of the engine at a predetermined value, and by a change-over valve which connects the housing chamber to the interior in the first operating position and to the tank in the second operating position.

In this construction, the pressure piston operates in known manner in the first operating position of the change-over valve. The higher interior pressure can have no effect on the pressure piston because it acts on both of its pressure faces. However, in the second operating position, the interior pressure acts on only one pressure face of the pressure piston because the housing chamber is not under pressure. Accordingly, a force acts on the pressure piston that is opposed to the force occasioned by the inflowing pressure fluid. As a result, the rotary valve is no longer sealingly pressed against the valve plate and along the face between the rotary valve and the valve plate there is created a short circuit between the inlet and outlet sides through which the free-wheeling property is obtained. The over-pressure valve as well as the change-over valve are comparatively small units which are much less expensive than a short circuiting valve for the pressure fluid.

It is desirable for the change-over valve to be disposed in a conduit which interconnects a connection leading to the interior and a connection leading to the housing chamber. In this way, the change-over valve can be located at a position where it is easily operated.

If there are internal connecting passages between the interior and the housing chamber, they should be sealed by a seal. Thus, the pressure piston may be penetrated by a pin carrying a sealing ring.

The over pressure valve can be disposed in the housing between the interior and a connection leading to the tank. The expense required for this is extremely low.

In a preferred embodiment, the change-over valve is controllable in response to a pressure signal derivable from the outlet side of the engine and moves to the second operating position when the outlet pressure exceeds a predetermined value. This increased pressure occurs, for example, if the engine is externally driven, e.g. when starting downhill, in which case free-wheeling is switched on automatically.

In many cases an interrupter is desirable for suppressing the pressure signal. This is sensible when, upon reversing, free-wheeling is not to occur automatically.

The invention will now be described in more detail with reference to preferred examples illustrated in the drawing. The single FIGURE is a longitudinal section through an engine according to the invention and the associated hydraulic circuit.

The illustrated engine comprises a housing 1 and consisting of a bearing block 3 provided with a flange 2, an intermediate member 4, an internally serrated ring gear 5 and an end member 6, these parts being held together by bolts (not shown). An externally serrated pinion 7 which is in mesh with the ring gear 5 and forms compression chambers 8 is connected by way of a first cardan shaft 9 to a main shaft 10 which is supported in the bearing portion by way of two roller bearings 11 and 12. A second cardan shaft 13 passes through a distributing valve 14 consisting of a fixed valve plate 15 and a rotary valve 16 which is connected to the cardan shaft 13. The cardan shaft 13 is supported at the end by a pin 17 which carries a sealing ring 18 and is accommodated in a bore of a non-rotary pressure piston 19.

This pressure piston 19 has its left-hand end face pressed against the rotary valve 16 by an annular spring 20. A first annular pressure face 21 faces a chamber 23 which is connected to the one main connection 22. A second annular pressure face 24 faces a chamber 26 connected to the second main connection 25. These chambers communicate with the compression chambers 8 by way of passages 27 and 28 in the rotary valve 16 and by way of passages 29 in the valve plate 15 in such a manner that the engine is able to turn. Further, the pressure piston 19 has a pressure face 30 facing the interior chamber 31 of the engine and a pressure face 32 facing a housing chamber 33.

The internal chamber 31 communicates by way of a passage 34 with an over-pressure valve 35 having a connection 36 connected by a conduit 37 to a tank 38. Leakage oil collecting in the internal chamber 31 therefore has a predetermined pressure, for example, 10 bar.

Further, the internal chamber 31 is provided with a connection 39 which, by way of a conduit 40 having a change-over valve, 41 is connected to a connection 42 leading to the housing chamber 33. The change-over valve 41 has a first operating position a, in which the internal chamber 31 is connected to the housing chamber 33, and a second operating position b in which the housing chamber 33 is connected to the tank 38. In the present case, the change-over valve 41 moves to the second operating position b when a pressure signal supplied by a conduit 43 overcomes the force of the spring 44.

To operate the engine, a regulatable pump 45 is connected to the main connection 22 by way of an operating conduit 46 and to the main connection 25 by way of an operating conduit 47. The pressure medium then flows in the direction given by the arrows shown in full lines. If, during this manner of operation, the engine is driven by external forces, the pressure at the point 48 in the operating conduit 47 rises so that the change-over valve 41 responds. By means of an interrupter valve 49, the pressure signal can be suppressed if the change-over step is not desired, for example during reverse travel, when the flow is in the direction of the broken lines.

An auxiliary pump 50 coupled to the regulatable pump 45 is associated with an over-pressure valve 51 and, by way of two check valves 52 and 53, tends to feed that amount of pressure fluid into the operating circuit which is lost in the engine through the leakage fluid flowing out through the interior chamber 31.

During normal operation, the same pressure of for example 10 bar obtains in the internal chamber 31 and in the housing chamber 33. Since the pressure faces 30 and 32 are equal, the pressure piston 19 is not loaded thereby. The only force acting on it is that of the spring 20 and the supply pressure acting on the pressure face 21. The rotary valve 16 is therefore not pressed against the valve plate 15. However, if the change-over valve 41 is switched over, the pressure in the housing chamber 33 becomes zero. The interior pressure acting on the pressure face 30 now exerts a considerable force on the pressure piston 19 in a direction opposite to the pressing-on force. Since the rotary valve 16 is no longer pressed against the valve plate 15 at full force, the fluid under the supply pressure tends to push the parts 15 and 16 apart so that a short circuit path is created, which corresponds to the desired free-wheeling condition.

The principle as described is applicable to differently constructed hydraulic planetary piston engines, for example to those in which there is no pin 17. The change-over valve 41 can also be manually actuated.

We claim:

1. A hydraulic planetary piston engine, comprising, an externally serrated pinion gear with a splined bore and an internally serrated ring gear in mesh therewith, drive side and valve side housing means attached to opposite sides of said ring gear, said housing means defining inlet and outlet ports, drive means rotatably mounted in said drive side housing means, first cardan shaft means connecting said drive means to said pinion gear, valve means in said valve side housing means including a fixed annularly shaped plate valve member attached to said ring gear and a rotatable annularly shaped plate valve member in sealing engagement therewith, second cardan shaft means connecting said rotatable valve member to said pinion gear, a confined interior chamber defined by said drive side housing and said valve means in conjunction with said pinion gear bore, piston means having inner and outer pressure areas on opposite inner and outer axial sides thereof having respective fluid communication with said inlet and outlet ports, said piston means being in bisable engagement with said rotatable valve member, said piston means having inner and outer pressure faces with said inner face being in fluid communication with said confined interior chamber, passage means externally of said housing means for connecting said confined interior chamber to said outer pressure face of said pressure piston means, changeover valve means in said passage means having a first position placing said confined interior chamber and said outer pressure face in fluid communication to bias said rotatable valve member into sealing engagement with said fixed valve member and a second position connecting said outer pressure face to atmosphere to effect a releasing of said sealing engagement between said valve members.

2. Hydraulic apparatus according to claim 1, including over pressure valve means for limiting the pressure in said confined interior chamber to a predetermined value.

3. Hydraulic apparatus according to claim 1 wherein said piston means is annularly shaped forming a bore and sealing means are disposed in said piston means bore.

4. Hydraulic apparatus according to claim 1 including means responsive to output pressure of said engine to effect shifting of said changeover valve means to said second position at a predetermined output pressure.

* * * * *